US006527087B2

(12) United States Patent
Ito et al.

(10) Patent No.: US 6,527,087 B2
(45) Date of Patent: Mar. 4, 2003

(54) LUBRICATING SYSTEM FOR INTERNAL COMBUSTION ENGINE

(75) Inventors: Katsuhiko Ito, Saitama (JP); Kenji Okubo, Saitama (JP); Akio Senda, Saitama (JP); Masahiro Inoue, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/852,670

(22) Filed: May 11, 2001

(65) Prior Publication Data

US 2002/0003064 A1 Jan. 10, 2002

(30) Foreign Application Priority Data

May 11, 2000 (JP) ..... 2000-138426

(51) Int. Cl.[7] ..... F01M 1/04
(52) U.S. Cl. ..... 184/6.5; 184/18
(58) Field of Search ..... 184/6.5, 6.12, 184/18, 1.5

(56) References Cited

U.S. PATENT DOCUMENTS 4,616,609 A * 10/1986 Munch et al. ..... 123/196 AB
5,078,233 A * 1/1992 Oetting et al. ..... 184/6.5
5,103,782 A * 4/1992 Matsui ..... 123/195 C
5,587,068 A * 12/1996 Aho et al. ..... 96/210
5,638,775 A * 6/1997 Hollis ..... 123/41.55
6,089,213 A * 7/2000 Laudien et al. ..... 123/572
6,457,564 B1 * 10/2002 Damm et al. ..... 184/6.5
2002/0003064 A1 * 1/2002 Ito et al. ..... 184/6.5

FOREIGN PATENT DOCUMENTS

JP 6181873 4/1986
JP 2523715 10/1996

* cited by examiner

*Primary Examiner*—David Fenstermacher
(74) *Attorney, Agent, or Firm*—Birch, Stewart, Kolasch & Birch, LLP

(57) ABSTRACT

To reduce the size and weight of an oil tank for a dry sump type lubricating system. A separate oil tank of a dry sump type lubricating system is mounted on the front surface of a front case cover constituting part of a crankcase divided into front and rear parts. An effective volume portion, in which oil supplied from the crankcase side via scavenging pumps and cooled by an oil cooler is contained, is provided in the oil tank. The bottom portion of the effective volume portion is connected to a feed pump on the crankcase side via an outlet side passage. A tank side pipe portion extending rearwardly through the oil tank is integrally provided at a portion of the oil tank higher than the oil level in the oil tank. The tank side pipe portion is connected to a crankcase side pipe portion integrally provided on an upper portion of the front case cover to form an overflow passage. The overflow passage functions as a pressure-equalization passage for equalizing the pressure in the oil tank with the pressure in the crankcase, and allows overflowed oil in the oil tank to readily flow into the crankcase through the upper portion of the front case cover.

16 Claims, 5 Drawing Sheets

LUBRICATING SYSTEM FOR INTERNAL COMBUSTION ENGINE

BACKGROUND OF THE INVENTION

1. Field of the Invention

The present invention relates to a dry sump type lubricating system. In particular, the present invention relates to a dry sump type lubricating system capable of reducing the weight and size of an oil tank.

2. Description of Background Art

Dry sump type lubricating systems have been configured such that an oil tank is provided separately from an engine. The oil tank is in communication with a feed pump and a scavenging pump provided on the engine side via oil hoses. For example, Japanese Patent Publication No. Hei 4-3115 discloses a dry sump type lubricating system in which an oil tank is disposed at the back of an engine. The oil tank is supported on a body frame in such a manner as to be separated from the engine. Furthermore, Japanese Utility Model Registration No. 2523715 discloses a dry sump type lubricating system in which an oil tank is supported on a side surface of an air cleaner.

In addition, while not described in the above-described documents, in a dry sump type lubricating system, the pressure in the oil tank is required to be equal to the pressure in the crankcase of the engine. Accordingly, to satisfy such a requirement, for example, as shown by a virtual line in FIG. 3 of the present invention, a pressure-equalization hose 92 may be often formed by connecting a pipe 91 projecting from a top 90 of an oil tank 20 to a crankcase 10 via a pressure-equalization hose 92. In this case, however, to prevent overflowing oil in the oil tank 20 from flowing in the pressure-equalization hose 92, a space capable of containing the overflowed oil must be ensured at an upper portion of the oil tank 20. Accordingly, the size and weight of the oil tank 20 must be increased as shown by the top 90 designated by the virtual line. Furthermore, since the oil tank 20 is connected to the crankcase 10 via the pressure-equalization hose 92, the number of assembling steps increases. Accordingly, an object of the present invention is to solve such a problem.

SUMMARY OF THE INVENTION

To solve the above problem, according a first aspect of the present invention, there is provided a lubricating system for an internal combustion engine, including a feed pump for supplying oil in an oil tank to portions to be lubricated of the internal combustion engine, and a scavenging pump for returning oil accumulated in the internal combustion engine to the oil tank, wherein an overflow passage for allowing overflowed oil from the oil tank to flow to the crankcase side is provided between a portion of the oil tank, higher than the oil level, and a crankcase of the engine.

According to a second aspect of the present invention, in addition to the configuration of the first aspect of the present invention, the overflow passage includes a tank side pipe portion integrally formed in the oil tank and a crankcase side pipe portion integrally formed in the crankcase, and the tank side pipe portion is directly connected to the crankcase side pipe portion.

According to the first aspect of the present invention, overflowed oil in the oil tank flows to the crankcase side through the overflow passage provided at a portion of the oil tank higher than an oil level. As a result, a volume for containing the overflowed oil is not required over the oil level of the oil tank. Accordingly, the weight and size of the oil tank can be reduced. Furthermore, since the overflow passage communicates the oil tank to the inside of the crankcase, and thereby functions to equalize the pressure in the oil tank with the pressure in the crankcase, the overflow passage can serve as a pressure-equalization passage as well. As a result, it is not required to provide a pressure-equalization passage separately from the overflow passage.

According to the second aspect of the present invention, since the overflow passage can be formed by directly connecting the tank side pipe portion integrally formed in the oil tank to the crankcase side pipe portion integrally formed in the crankcase, it is not required to connect the oil tank to the crankcase via a separate pressure-equalization hose as in the prior art, with the result that it is possible to reduce the number of assembling steps and hence to facilitate the assembly.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
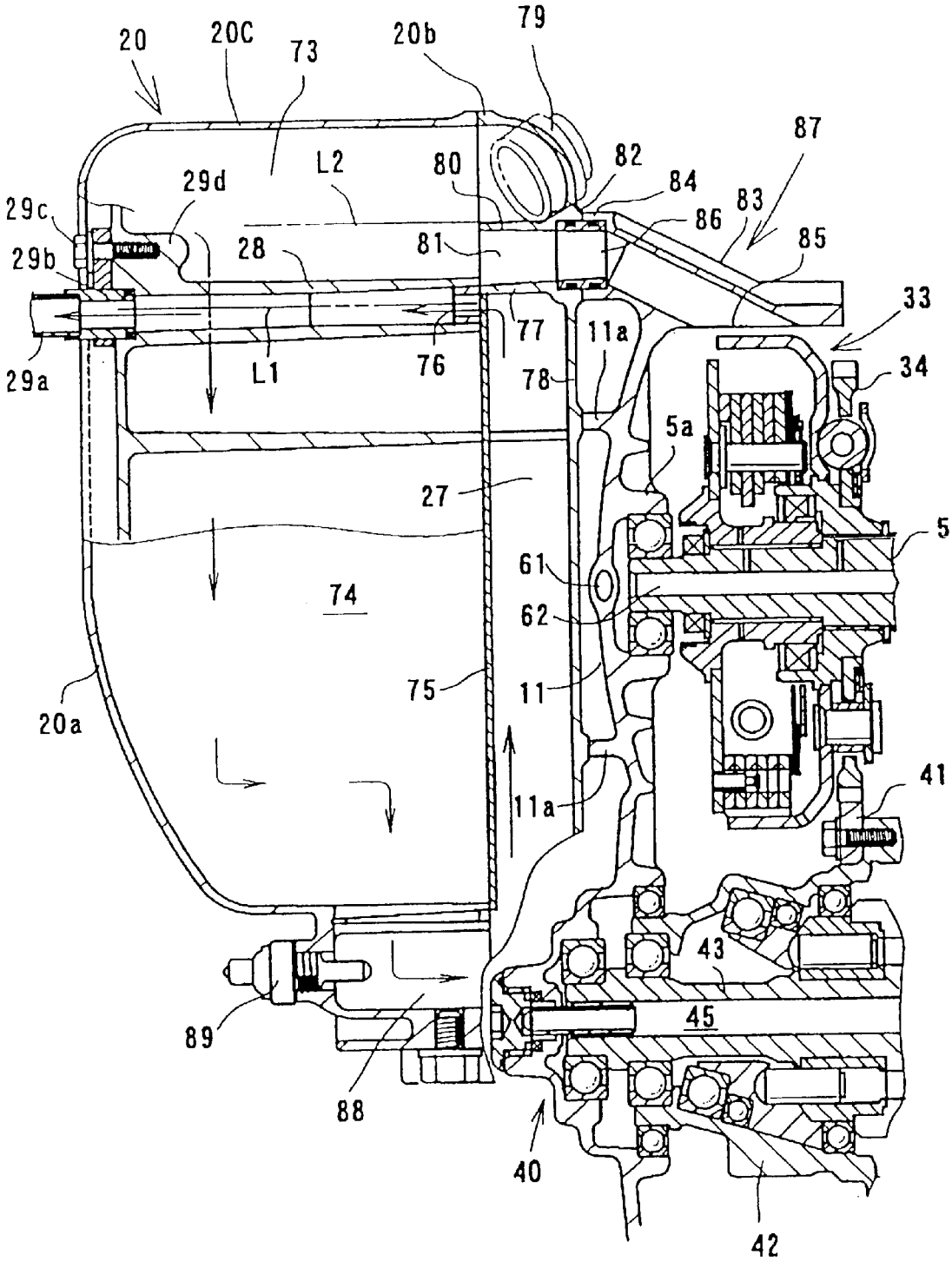
FIG. 1 is a sectional view illustrating the structure of an overflow passage according to a first embodiment of the present invention.
Figure 2:
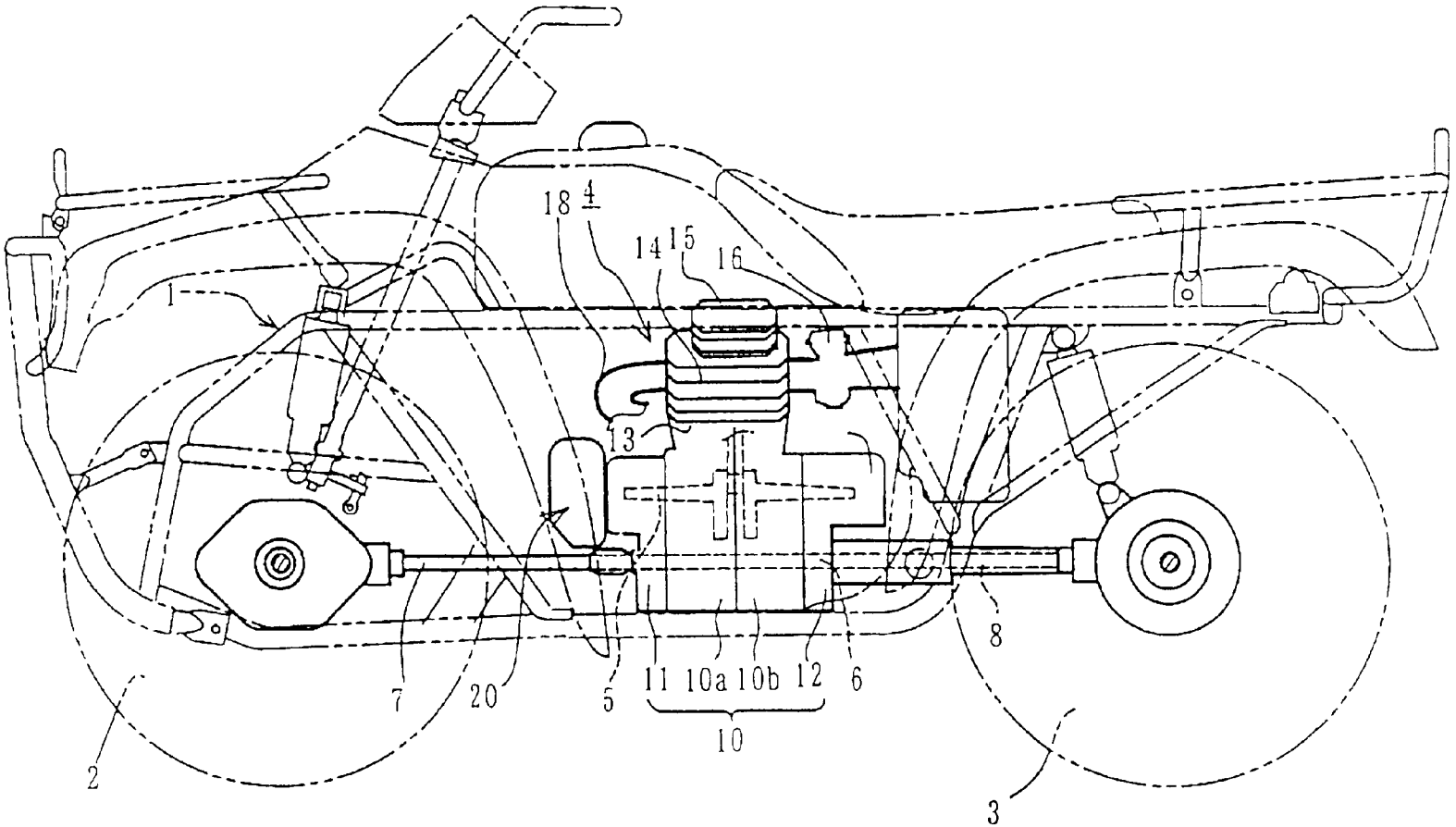
FIG. 2 is a side view illustrating an essential portion of a vehicular body of a four-wheel buggy to which the first embodiment of the present invention is applied.
Figure 3:
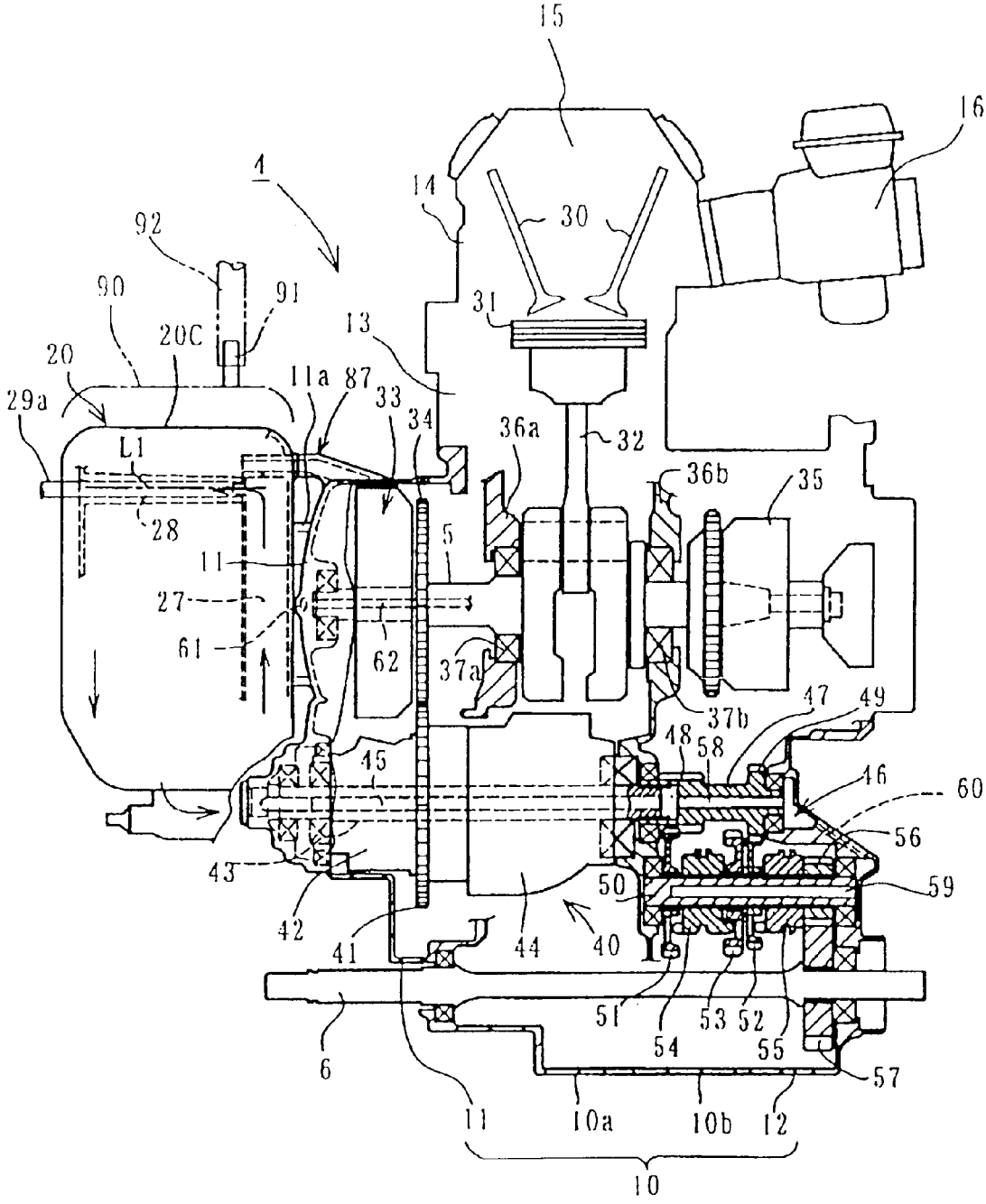
FIG. 3 is a vertical sectional view of a power unit.
Figure 4:
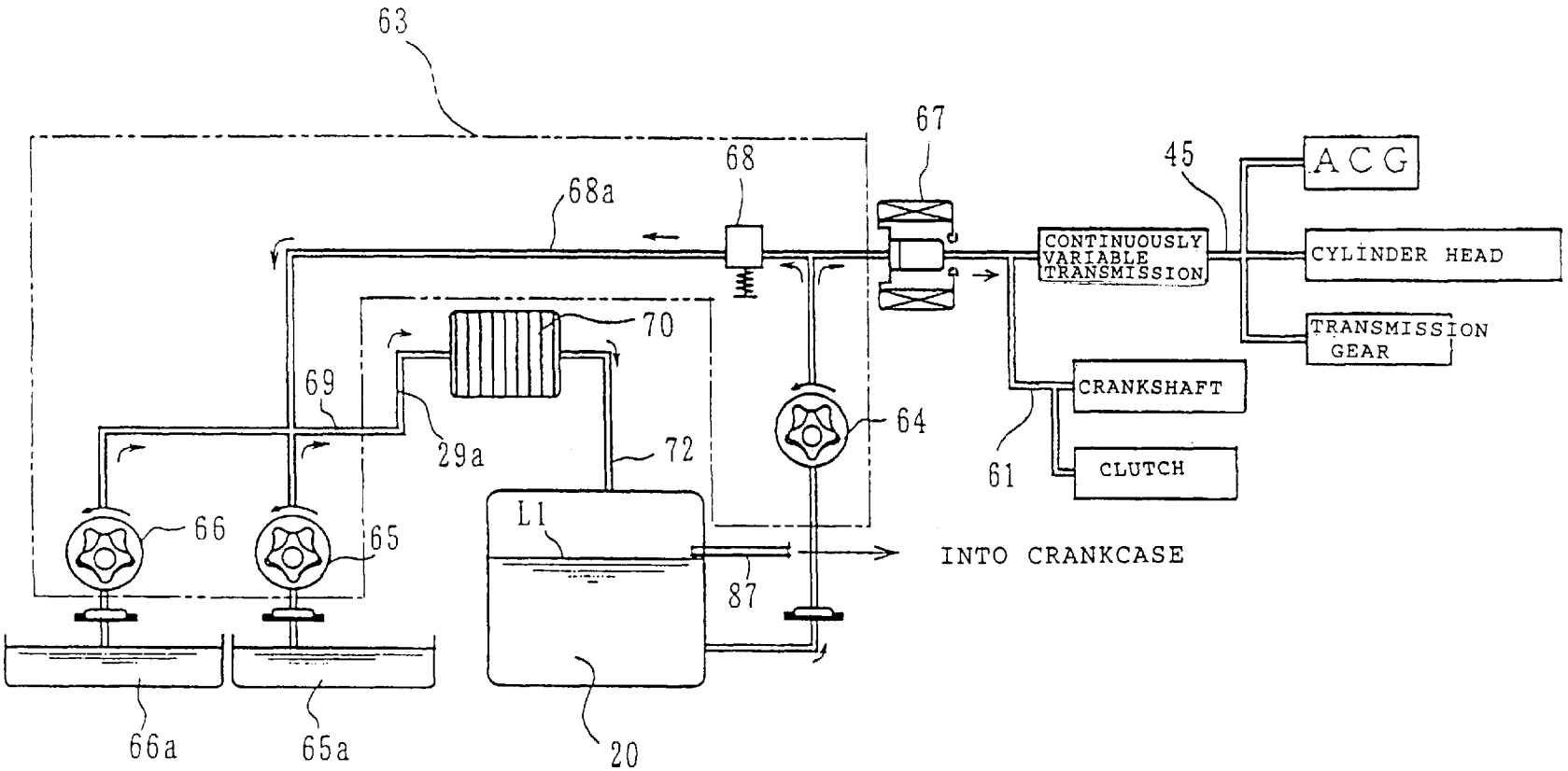
FIG. 4 is a diagram illustrating a lubrication distribution system.
Figure 5:
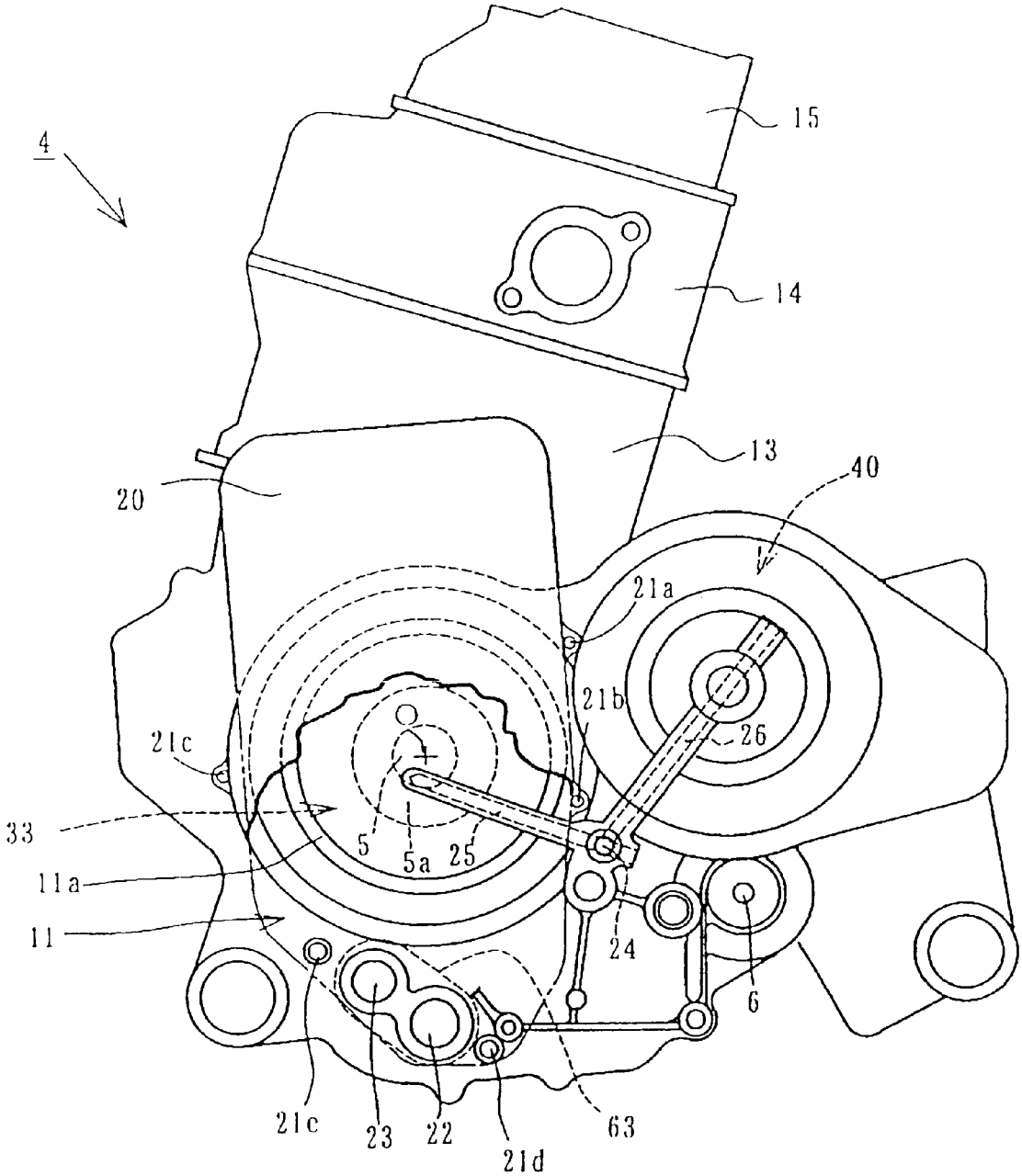
FIG. 5 is a view illustrating a mounting state of an oil tank from the front surface of the vehicular body, with parts partially cutaway.

Hereinafter, one embodiment of the present invention, wherein the present invention is applied to a four-wheel buggy will be described with reference to the accompanying drawings. FIG. 1 is a sectional view illustrating an overflow passage according to a first embodiment of the present invention; FIG. 2 is a side view illustrating an essential portion of a vehicular body of a four-wheel buggy according to the first embodiment; FIG. 3 is a vertical sectional view, taken on a plane parallel to a crankshaft and drive shafts of a hydrostatic type continuously variable transmission, illustrating a power unit; FIG. 4 is a diagram illustrating a lubrication distribution system; and FIG. 5 is a view illustrating an oil tank and the power unit from the front surface of the vehicular body, with parts partially cutaway, for illustrating a state in which the oil tank is mounted on the power unit.

A general structure of a four-wheel buggy will be briefly described with reference to FIG. 2. The four-wheel buggy is configured such that a pair of right and left front wheels 2 are provided on the front side of a body frame 1, while a pair of right and left rear wheels 3 are provided on the rear side of the body frame 1. A power unit 4 including an engine and a transmission integrated therewith is supported at a central portion of the body frame 1. The power unit 4 is of a longitudinal type in which a crankshaft 5 extends in the longitudinal direction of the vehicular body. The four-wheel buggy, which is of a four-wheel drive type, is driven such that the front wheels 2 and the rear wheels 3 are driven, via a front wheel propeller shaft 7 and a rear wheel propeller shaft 8, by an output shaft 6 provided at a lower portion of the power unit 4 in such a manner as to extend in parallel to the crankshaft 5.

The front side of a crankcase 10 constituting part of the power unit 4 is covered with a front case cover 11, and the rear side of the crankcase 10 is covered with a rear case cover 12. The front case cover 11 and the rear case cover 12 constitute part of the crankcase 10. A main body of the crankcase 10 is divided in the longitudinal direction into a front case 10*a* and a rear case 10*b*.

A cylinder block 13, a cylinder head 14, and a cylinder head cover 15 are mounted on an upper portion of the crankcase 10. A carburetor 16 is connected to an inlet port of the cylinder head 14, and an air cleaner 17 disposed behind the carburetor 16 is connected to the carburetor 16. An exhaust pipe 18 is connected to an outlet port of the cylinder head 14.

An oil tank 20 is directly mounted to the front surface of the front case cover 11. The oil tank 20 has a shape extending longer in the vertical direction than the horizontal direction and also has a large capacity as shown in FIG. 5. The oil tank 20 is mounted to the front case cover 11 by means of five bolts 21*a*, 21*b*, 21*c*, 21*d*, and 21*e*. The bolts 21*a* and 21*b* are located at upper and lower positions on one side with respect to the center O of the crankshaft 5, and the bolt 21*c* is located at a position slightly upwardly from the center O of the crankshaft 5 on the other side with respect to the center O of the crankshaft 5. In addition, the bolts 21*a* and 21*b* are located with a bearing portion 5*a* of the crankshaft 5 provided in the front case cover 11 located therebetween in the vertical direction. Furthermore, the bolts 21*d* and 21*e* extend up to the crankcase 10 astride an oil passage, to be fastened to the crankcase 10.

As shown in FIG. 5, a mounting seat 11*a* of the oil tank 20 is integrally formed on the front surface of the front case cover 11. An inlet 22 of the oil tank 20, through which oil is fed from the oil tank 20 to an oil pump, and an outlet 23 of the oil tank 20, through which oil is fed from the oil pump to the oil tank 20 are provided in a lower portion of the front case cover 11 at positions under the crankshaft 5. The inlet 22 and outlet 23 are obliquely offset from each other in the vertical direction. The inlet 22 and outlet 23 are directly in communication with a lower portion of the oil tank 20. An oil pump 63 schematically shown by a dashed line is contained inside the front case cover 11, and is composed of a feed pump and a scavenging pump. The inlet 22 is in communication with the suction side of the feed pump and the outlet 23 is in communication with the discharge side of the scavenging pump.

An oil passage through which oil is supplied from the oil pump 63 to portions of the engine to be lubricated includes a main oil passage 24 provided inside the front case cover 11, and oil passages 25 and 26 branched in a V-shape from the main oil passage 24. The oil passage 25 extends to a starting clutch 33 side while passing through the wall of the front case cover 11, and opens in the vicinity of the leading end portion of the crankshaft 5. The oil passage 26 extends to a hydrostatic type continuously variable transmission 40 side while passing through the wall of the front case cover 11 in order to supply drive oil to the hydrostatic type continuously variable transmission 40 and to supply the drive oil to other portions of the engine to be lubricated by way of the hydrostatic type continuously variable transmission 40.

The oil, which has been used for lubricating the portions of the engine, is returned to the oil tank 20 by the scavenging pump. As shown in FIGS. 1 and 3, the inside of the oil tank 20 is partitioned into a front portion and a rear portion. An initial cooling passage 27 connected to the outlet 23 of the front case cover 11 (see FIG. 5) is provided in the rear portion of the oil tank 20 in such a manner as to extend in the vertical direction. An upper end portion of the initial cooling passage 27 is in communication with a rear end portion of a horizontal passage 28 crossing over an upper portion of the inside of the oil tank 20 substantially in the horizontal direction.

One end of a supply side oil cooler hose 29*a* is connected to the front end of the horizontal passage 28, and the other end of the supply side oil cooler hose 29*a* is connected to an oil cooler (which will be described later) disposed at a position different from that of the oil tank 20. While not shown, a return side oil cooler hose is connected to the oil tank 20, in addition to the supply side oil cooler hose 29*a*.

As is apparent from FIG. 1, the oil cooler hose 29*a* is connected to the horizontal passage 28 via a joint 29*b*, which is mounted to a boss 29*d* integral with the horizontal passage 28, by means of a bolt 29*c*. The height equal to an approximately center line of the oil cooler hose 29*a* is taken as an oil level L1, which is equivalent to an upper limit of oil to be contained in the oil tank 20.

A portion of the space in the oil tank 20 which is higher than the oil level L1 is taken as an air gap portion 73. An end portion of the return side oil cooler hose is connected to the oil tank 20 in such a manner as to face toward the air gap portion 73. A portion lower than the oil level L1 is taken as an effective volume portion 74. An upper portion of the effective volume portion 74 is in communication with the air-gap portion 73 via the neighborhood of the horizontal passage 28, to contain cooling oil returned from the oil cooler. A rear end portion of the effective volume portion 74 is partitioned from the initial cooling passage 27 by means of a front side passage wall 75.

The oil tank 20 is formed by joining two divided parts, i.e., a front portion 20*a* and a rear portion 20*b*, to each other in the longitudinal direction. The front side passage wall 75 acts as a partition wall and is disposed at a boundary where the front portion 20*a* is joined to the rear portion 20*b*. A pipe-like joint portion 76 projects sideways from an upper portion of the front side passage wall 75 by means of which the initial cooling passage 27 is partitioned from the effective volume portion 74. The joint portion 76 is fitted to the rear end portion of the horizontal passage 28, whereby the initial cooling passage 27 is in communication with the horizontal passage 28.

An upper portion of the initial cooling passage 27 is closed by a top wall 77. The top wall 77 is integral with a rear side passage wall of the initial cooling passage 27, i.e., a rear wall 78 of the rear portion 20*b* in such a manner that the height of the inner wall surface, facing toward the initial cooling passage 27, of the top wall 77 is nearly equal to that of the upper side of the horizontal passage 28. An oil filler port 79 is provided in an upper shoulder of the rear wall 78 in such a manner as to pass through the rear wall 78 obliquely in the vertical direction. The inner end of the oil filler port 79 faces toward the air-gap portion 73, and the lowermost portion of the oil filler port 79 forms an oil level L2. The oil filler port 79 projects rearwardly from the oil tank 20 in such a manner that the height of the uppermost portion, projecting outwardly from the rear wall 78, of the oil filler port 79 is nearly equal to the height of a top portion 20C of the oil tank 20.

Part of the top wall 77 forms a tank side pipe portion 80. The tank side pipe portion 80 includes a pipe hole 81 which passes through the top wall 77. The pipe hole 81 is positioned between the oil level L1 and the oil level L2 with its axial line directed substantially in the horizontal direction. An outlet 82 of the pipe hole 81 is opened in the rear surface of the rear wall 78 at a position under the oil port 79, and is connected to a front end portion 84 of a crankcase side pipe portion 83 provided in the front case cover 11.

The crankcase side pipe portion 83 is a pipe-like passage integrally formed in an upper portion of the front case cover 11 in such a manner as to project forwardly, obliquely upwardly therefrom. The front end portion 84, which is also an upper end portion, of the crankcase side pipe portion 83 is bent substantially in the horizontal direction, and is directly in communication with and connected to the outlet 82 of the pipe hole 81 of the tank side pipe portion 80. A rear end portion 85, which is also a lower end portion, of the crankcase side pipe portion 83 is opened in the upper portion of the front case cover 11. The position at which the rear end portion 85 of the crankcase side pipe portion 83 is opened, is higher than a starting clutch 33 to be described later, and lower than the oil level L1.

A positioning ring 86 is fitted in an inner surface of the portion at which the outlet 82 of the pipe hole 81 is connected to the front end portion 84 of the crankcase side pipe portion 83. When the oil tank 20 is mounted to the front case cover 11, the outlet 82 is aligned with the front end portion 84, and is easily connected thereto by fitting the outlet 82 or the front end portion 84 in the positioning ring 86 previously mounted to the front end portion 84 or the outlet 82. The portion at which the outlet 82 is connected to the front end portion 84 via the positioning ring 86 is sealed with a packing or O-ring mounted to the positioning ring 86.

The tank side pipe portion 80 and the crankcase side pipe portion 83 form a continuous overflow passage 87. In addition, reference numeral 88 designates an outlet side passage of the effective volume portion 74, which communicates the bottom portion of the effective volume portion 74 to the inlet 22 of the oil pump (see FIG. 5); and reference numeral 89 designates an oil temperature sensor having a detecting portion inserted in the outlet side passage 88.

The power unit will be described below in detail. In FIG. 3, reference numeral 30 designates a valve; 31 is a piston; 32 is a connecting rod; 33 is a starting clutch of a centrifugal clutch mechanism provided at one end of the crankshaft 5; 34 is a primary drive gear rotated integrally with a clutch outer of the starting clutch 33; and 35 is an ACG provided on the other end side of the crankshaft 5. The crankshaft 5 is rotatably supported by a journal wall 36*a* integral with the front case 10*a* via a main bearing 37*a* and a journal wall 36*b* integral with the rear case 10*b* via a main bearing 37*b*.

The known hydrostatic type continuously variable transmission 40 is contained in the crankcase 10 constituting part of an engine portion of the power unit 4. Approximately half of the hydrostatic type continuously variable transmission 40 in the length direction is located between the main bearings 37*a* and 37*b*. The hydrostatic type continuously variable transmission 40 includes a hydraulic pump 42 driven by a primary driven gear 41 meshed with the primary drive gear 34, and a hydraulic motor 44 driven by oil discharged from the hydraulic pump 42 for outputting a rotational force having a speed which is transferred to a drive shaft 43. The hydraulic motor 44 and the hydraulic pump 42 are disposed in parallel on the same drive shaft 43. The drive shaft 43 is disposed with its axial line directed in parallel to the crankshaft 5 in the longitudinal direction of the vehicular body.

An oil passage 45 is formed in the center of the drive shaft 43 in such a manner as to pass through the drive shaft 43 in the length direction. The primary drive gear 34 and the hydrostatic type continuously variable transmission 40 constitute primary reduction means. One end of the drive shaft 43 is directly spline-connected to a main shaft 47 of a stepping transmission 46. A first-speed drive gear 48 and a second-speed drive gear 49 are integrally provided on the main shaft 47. The gears 48 and 49 are meshed with a first-speed driven gear 51 and a second-speed driven gear 52 rotated on a counter shaft 50 disposed in parallel to the main shaft 47.

A reverse driven gear 53 is rotatably provided on the counter shaft 50, and is rotated in the direction reverse to the rotational direction of the first-speed driven gear 51 and the second-speed driven gear 52 by a reverse idle gear meshed with the first-speed drive gear 48 on a separate shaft (not shown).

Shifters 54 and 55 are spline-connected to the counter shaft 50 in such a manner as to be movable in the axial direction. When the shifter 54 is moved leftwardly in the figure, the first-speed driven gear 51 is fixed to the counter shaft 50, to transmit the rotation of the first-speed driven gear 51 from the counter shaft 50 to a final drive gear 56 integrally provided at the axial end of the counter shaft 50, and further to the output shaft 6 via a final driven gear 57 provided on the output shaft 6 in such a manner as to be meshed with the final drive gear 56.

When the shifter 55 is moved leftwardly, the rotation of the second-speed driven gear 52 is similarly transmitted to the output shaft 6, thereby achieving the second-speed drive mode. Furthermore, when the shifter 54 is moved rightwardly, the rotation of the reverse driven gear 53 is transmitted to the counter shaft 50, whereby the counter shaft 50 is reversely rotated, to reversely rotate the output shaft 6, thereby achieving a backward drive mode. The stepping transmission 46, final drive gear 56, and final driven gear 57 constitute secondary reduction means.

An oil passage 58 in communication with the oil passage 45 of the drive shaft 43 is formed in the center of the main shaft 47 in such a manner as to pass through the main shaft 47. An oil passage 59 similar to the oil passage 58 is formed in the center of the counter shaft 50. The oil passage 59, however, is configured such that an inner end thereof on the center side of the vehicular body is closed and an open end thereof on the outer side of the vehicular body faces toward an oil passage 60 formed in the wall of the rear case cover 12. Oil having passed through the main shaft 47 is supplied to the oil passage 60.

Oil supplied from the oil passage 58 is supplied, via an oil passage (not shown) provided in the rear case cover 12 separately from the oil passage 60, to the ACG 35 and a valve system of the cylinder head 14 for lubricating the ACG and the valve system. An oil passage 62 is formed in the center of the crankshaft 5. Oil is supplied to the oil passage 62 via an oil passage 61 provided in the front case cover 11, to lubricate the starting clutch 33 and the bearing portions of the crankshaft 5.

FIG. 4 is a diagram showing an oil feeding line. The oil pump 63 includes one feed pump 64 and two scavenging pumps, i.e., a main scavenging pump 65 and a sub-scavenging pump 66. The feed pump 64 sucks oil from the oil tank 20 and discharges the oil to an oil filter 67. The oil discharged in the oil filter 67 is further discharged to the oil passages 45 and 61 formed in the drive shaft 43 of the hydrostatic type continuously variable transmission 40.

Part of the oil supplied to the oil passage 45 functions as drive oil and lubrication oil for the hydrostatic type continuously variable transmission 40. The remaining oil is supplied, through the oil passage 45 as another lubricating oil passage, to respective portions of the engine, i.e., the ACG 35, the valve system of the valve 30 in the cylinder head 14, and the secondary reduction means such as the stepping transmission 46, to be thus used for lubricating them.

The oil supplied to the oil passage 61 lubricates the crankshaft 5 and the starting clutch 33. In addition, a discharge passage of the feed pump 64 is also in communication with a relief passage 68*a* via a relief valve 68. If the discharge pressure of the feed pump 64 exceeds a specific value, the excess pressure is relieved to the relief passage 68*a*.

The main scavenging pump 65 and the sub-scavenging pump 66 pump up oil accumulated in oil sumps 65*a* and 66*a* separated from each other, respectively. Each of the oil sumps 65*a* and 66*a* is formed by the bottom portion of the crankcase 10 or an oil pan. The oil pumped up by the main scavenging pump 65 and the sub-scavenging pump 66 and the oil from the relief passage 68*a* are discharged into a collection discharge passage 69. The oil thus collected in the collection discharge passage 69 is then supplied to an oil cooler 70 disposed at a suitable location of the vehicular body via the supply side oil cooler hose 29*a*. The oil cooled in the oil cooler 70 is returned to the oil tank 20 via a return side hose 72. It is to be noted that the collection discharge passage 69 and the oil cooler hose 29*a* are shown in FIG. 4 as being separated from the oil tank 20 for an easy understanding.

The function of this embodiment will be described below. The oil, which has been used for lubrication, is supplied from the power unit 4 side to the oil tank 20 via the scavenging pumps, and is supplied to the oil cooler 70 via the initial cooling passage 27 and the horizontal passage 28 of the oil tank 20, to be cooled by the oil cooler 70. The oil thus cooled is then returned to the air-gap portion 73 provided in the upper portion of the oil tank 20, and is dropped in the effective volume portion 74 while being cooled. The oil dropped in the effective volume portion 74 is returned from the outlet side passage 88 provided in the bottom portion of the oil tank 20 to the inlet 22 of the front case cover 11, and is supplied to portions to be lubricated by the feed pump. After that, the oil is repeatedly circulated along the flow path described above.

At this time, the oil at a high temperature supplied from the power unit 4 side into the oil tank 20 through the outlet 23 by the scavenging pumps is somewhat cooled during upward movement thereof in the initial cooling passage 27. Furthermore, since the oil returned from the oil cooler 70 is discharged into the air-gap portion 73 formed in the upper portion of the oil tank 20, the oil is then sufficiently cooled during downward movement thereof in the effective volume portion 74 in the direction toward the bottom of the oil tank 20. In this way, it is possible to improve the oil cooling efficiency.

Since the continuous overflow passage 87 formed by the tank side pipe portion 80 and the crankcase side pipe portion 83 communicates the oil tank 20 to the inside of the crankcase 10, the overflow passage 87 functions as a pressure-equalization passage for equalizing the pressure in the oil tank 20 with the pressure in the crankcase 10, thereby achieving the pressure-equalization effect required for the dry sump type lubricating system.

If the oil level in the oil tank 20 exceeds the oil level L1 for some reason to cause an overflow state, the overflowed oil enters the pipe hole 81 of the tank side pipe portion 80 opened at a position higher than the oil level L1, readily flowing in the crankcase side pipe portion 83 extending rearwardly, obliquely downwardly from the outlet 82, and enters the front case 10*a* from the rear end portion 85 of the crankcase side pipe portion 83.

Accordingly, the oil level can be kept at the oil level L1 or less by allowing the overflowed oil to readily flow into the crankcase 10. Furthermore, since the overflowed oil entering the front case 10*a* flows from a top to a bottom of the starting clutch 33, the oil can be effectively used for lubricating portions to be lubricated in the front case 10*a*.

In this way, since the continuous overflow passage 87 formed by the tank side pipe portion 80 and the crankcase side pipe portion 83 is disposed between a portion higher than the oil level L1 of the oil tank 20 and an upper front portion of the front crankcase cover 11 constituting part of the crankcase 10, the overflowed oil is allowed to readily flow to the crankcase 10 side. As a result, it is not required to ensure an additional volume necessary for containing the overflowed oil, in the upper portion higher than the oil level L1 of the oil tank 20.

Accordingly, the oil tank 20 can be made smaller in weight and size than the background art large-sized oil tank having the top 90 located at a high position as shown by the virtual line in FIG. 3. Furthermore, since the overflow passage 87 can serve as a pressure-equalization passage, it is possible to eliminate the need for providing a pressure-equalization passage separately from the overflow passage, and hence simplify the lubricating structure.

Since the tank side pipe portion 80 and the crankcase side pipe portion 83 constituting the overflow passage 87 are integrally provided on the rear portion 20*b* of the oil tank 20 and the front case cover 11, respectively, and the tank side pipe portion 80 is directly connected to the crankcase side pipe portion 83, it is not required to additionally provide the separate pressure-equalization hose 92 as in the background art structure (see FIG. 3).

Furthermore, since the tank side pipe portion 80 can be connected to the crankcase side pipe portion 83 at the same time when the oil tank 20 is mounted to the front case cover 11, it is possible to reduce the number of assembling steps and hence to facilitate assembly. The work required to connect the tank side pipe portion 80 to the crankcase side pipe portion 83 can be smoothly performed by using the positioning ring 86. Furthermore, the connecting portion therebetween can be effectively sealed by a packing or O-ring mounted to the positioning ring 86.

Since the oil tank 20 is directly mounted to the front surface of the front case cover 11, it is possible to omit expensive heavy hoses for connecting the oil tank 20 and the oil pumps, and hence reduce the weight and cost of the lubricating system and also to reduce the number of assembling steps required for connecting the oil hoses. Furthermore, even if the volume of the oil tank 20 increases to supply a large amount of drive oil to the hydrostatic type continuously variable transmission 40, it is possible to easily ensure a mounting location of the oil tank 20, and hence facilitate the layout of the vehicular body.

Since the oil tank 20 is disposed on the front surface of the power unit 4, it is expected to improve the oil cooling efficiency by running wind, and it is possible to lower the center of gravity of the vehicular body by a mass concentration effect. Furthermore, since the bolts 21*a* and 21*b* are disposed on the upper and lower side with respect to the crankshaft 5 at the time of mounting the oil tank 20, even if the heavy oil tank 20 is supported by the front case cover 11, it is possible to suppress the off-center of the crankshaft 5, supported via the bearings by the front case cover 11, from the bearings.

In addition, the overflow passage may not necessarily be formed by the tank side pipe portion 80 and the crankcase side pipe portion 83 provided on the oil tank 20 and the front case cover 11, respectively. For example, in place of the two pipe portions, i.e., the tank side pipe portion 80 and the crankcase side pipe portion 83, only one pipe-like portion and a simple opening portion to which the leading end of the pipe-like portion is to be connected may be adopted. Furthermore, the overflow passage 87 may be configured as a pipe-like passage member formed separately from the oil tank 20 and the front case cover 11. Additionally, the present invention is applicable not only to a dry sump type internal combustion engine for a four-wheel buggy but also to dry sump type internal combustion engines for various vehicles.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A lubricating system for an internal combustion engine, comprising:

a feed pump for supplying oil in an oil tank to portions of the internal combustion engine to be lubricated;

a scavenging pump for returning oil accumulated in the internal combustion engine to said oil tank; and wherein an overflow passage for allowing overflowed oil from said oil tank to flow to the crankcase is provided between a portion of said oil tank higher than an oil level in said oil tank and a crankcase.

2. The lubricating system for an internal combustion engine according to claim 1, wherein said overflow passage includes a tank side pipe portion integrally formed in said oil tank and a crankcase side pipe portion integrally formed in the crankcase, and said tank side pipe portion is directly connected to said crankcase side pipe portion.

3. The lubricating system for an internal combustion engine according to claim 1, wherein the oil tank is mounted directly to a front surface of a front case cover of the crank case.

4. The lubricating system for an internal combustion engine according to claim 3, wherein an inlet of the oil tank and an outlet of the oil tank are provided in a lower portion of the front case cover at a position below a crankshaft of the engine, said inlet and outlet being obliquely offset from each other and in direct communication with the oil tank.

5. The lubricating system for an internal combustion engine according to claim 1, wherein oil from the feed pump is supplied to a main oil passage and a pair of secondary oil passages, said pair of secondary oil passages extending from the main oil passage away from each other.

6. The lubricating system for an internal combustion engine according to claim 5, wherein one of said pair of secondary oil passages extends to the crankshaft and a clutch of the engine for lubricating the crankshaft and the clutch.

7. The lubricating system for an internal combustion engine according to claim 5, wherein one of said pair of secondary oil passages extends to a hydrostatic type continuously variable transmission to lubricate the hydrostatic type continuously variable transmission.

8. The lubricating system for an internal combustion engine according to claim 1, wherein the oil tank includes an initial cooling passage connected to the outlet of the oil tank, said initial cooling passage extends substantially in the vertical direction and is located at a rear of the oil tank directly in front of the front case cover.

9. An internal combustion engine, comprising:

a crankcase having a front case cover and a rear case cover mounted on front and rear cases, respectively;

a crank shaft mounted for rotation within said crank case;

an oil tank;

a feed pump for supplying oil in said oil tank to portions of the internal combustion engine to be lubricated;

a scavenging pump for returning oil accumulated in the internal combustion engine to said oil tank; and wherein an overflow passage for allowing overflowed oil from said oil tank to flow to said crankcase is provided between a portion of said oil tank higher than an oil level in said oil tank and said crankcase.

10. The internal combustion engine according to claim 9, wherein said overflow passage includes a tank side pipe portion integrally formed in said oil tank and a crankcase side pipe portion integrally formed in said crankcase, and said tank side pipe portion is directly connected to said crankcase side pipe portion.

11. The internal combustion engine according to claim 9, wherein said oil tank is mounted directly to a front surface of said front case cover of said crank case.

12. The internal combustion engine according to claim 11, wherein an inlet of said oil tank and an outlet of said oil tank are provided in a lower portion of said front case cover at a position below said crankshaft, said inlet and outlet being obliquely offset from each other and in direct communication with said oil tank.

13. The internal combustion engine according to claim 9, wherein oil from said feed pump is supplied to a main oil passage and a pair of secondary oil passages, said pair of secondary oil passages extending from the main oil passage away from each other.

14. The internal combustion engine according to claim 13, wherein one of said pair of secondary oil passages extends to said crankshaft and a clutch of the engine for lubricating saidcrankshaft and said clutch.

15. The internal combustion engine according to claim 13, wherein one of said pair of secondary oil passages extends to a hydrostatic type continuously variable transmission to lubricate the hydrostatic type continuously variable transmission.

16. The internal combustion engine according to claim 9, wherein said oil tank includes an initial cooling passage connected to said outlet of said oil tank, said initial cooling passage extends substantially in the vertical direction and is located at a rear of said oil tank directly in front of front front case cover.

* * * * *